United States Patent [19]

Tew

[11] Patent Number: 4,468,886

[45] Date of Patent: Sep. 4, 1984

[54] WALL MOUNTABLE SAFETY HATCH

[76] Inventor: George A. Tew, Box 398, Pawhuska, Okla. 74056

[21] Appl. No.: 508,940

[22] Filed: Jun. 29, 1983

[51] Int. Cl.[3] ..... E05B 65/10; E06B 1/04

[52] U.S. Cl. ..... 49/141; 49/61; 52/127.8; 52/204

[58] Field of Search ..... 52/19, 204, 196, 127.1, 52/127.6, 127.8, 202; 49/141, 61, 62, 142

[56] References Cited

U.S. PATENT DOCUMENTS

| | | | |
|---|---|---|---|
| 484,515 | 10/1892 | Cochran | 52/19 |
| 2,793,721 | 5/1957 | Sterud | 52/204 |
| 2,830,843 | 4/1958 | Seaburg et al. | 49/141 |
| 3,032,834 | 5/1962 | Carlson | 49/141 |
| 3,120,032 | 2/1964 | Burnette | 49/141 |
| 3,220,079 | 11/1965 | Aggson | 52/204 |
| 3,576,092 | 4/1971 | Halpern | 52/204 |
| 3,836,187 | 9/1974 | Buettner | 49/67 |
| 3,968,607 | 7/1976 | Baran | 52/204 |
| 3,992,052 | 11/1976 | Green | 49/141 |
| 4,106,236 | 8/1978 | Oliphant | 49/141 |
| 4,370,828 | 2/1983 | Miro | 52/204 |

*Primary Examiner*—John E. Murtagh
*Assistant Examiner*—Andrew Joseph Rudy
*Attorney, Agent, or Firm*—Head, Johnson & Stevenson

[57] ABSTRACT

A wall mountable safety hatch comprising a pair of telescopically engagable door frames that insert through a conventional studded wall forming an emergency exit. A pair of flush mounted doors insert into the wall mounted frame and are held in proper alignment by a seat belt type fastener. Upon releasing the conventional seat belt clasp, the door falls from the frame exposing the emergency escape hatchway.

5 Claims, 6 Drawing Figures

WALL MOUNTABLE SAFETY HATCH

BACKGROUND OF THE INVENTION

1. Field of the Invention:

This invention relates to a wall mountable safety hatch. More specifically, the invention relates to a safety door escape hatch held in place by a seat belt like system for emergency exit from a room or the like.

2. Description of the Prior Art:

The basic concept of providing the exterior wall of a building, house trailer or similar dwelling with an emergency escape hatch or door is generally known and a commercially accepted practice. Such doors are usually installed in the outside wall to afford an emergency exit in case of a fire or other disaster. Historically, many different types of manually operated mechanisms have been suggested for opening the escape hatch door which principally has led to confusion and risk of operator error during an emergency, particularly in that many of the mechanisms are not readily recognizable by everyone and specifically young children. For example, in U.S. Pat. Nos. 3,032,834 and 3,120,032 releasable emergency escape doors are disclosed wherein the manually operated release mechanism involves a centrally located handle which has to be twisted to withdraw internal latching rods. In U.S. Pat. No. 3,992,052 an escape door for trailers is disclosed wherein a cap has to be removed in order to expose a ball which is pushed to activate the spring loaded door. And, U.S. Pat. No. 4,106,236 discloses a fire door which is equipped with a pivoting latch which after being turned 180° allows the person to spin the door on a vertical axis. The difficulty with any or all of these proposed emergency hatches is that their mode of operation and method of use is not readily recognizable and as such, are not to be considered fail safe mechanically, particularly during a crisis situation. Thus, the need for a safety hatch which will automatically activate by virtue of performing an act that is quickly recognized by even young children during an emerency still exists.

SUMMARY OF THE INVENTION

In view of the prior art devices and the need for a safety hatch that is compatible with contemporary construction I have discovered a wall mountable safety hatch comprising:

(a) a first wall mountable frame comprising a first closed-loop flange member adapted to mount against an inner wall and surround an opening in the wall through which a human can escape, a first door engaging means attached to the interior perimeter of the first flange member, and a first closed-loop sidewall member having one end attached to the first door engaging means, thus extending away from the flange member and substantially through the opening in the wall;

(b) a second wall mountable frame comprising a second closed-loop flange member adapted to mount against an exterior wall and surround an opening in the wall through which a human can escape, a second door engaging means attached to the interior perimeter of the second flange member, and a second closed-loop sidewall member having one end attached to the second door engaging means thus extending away from the flange member and substantially through the opening in the wall;

(c) an outer door means comprising an exterior wall member and first strap member with connector at one end of said strap member, and the other end of said first strap member, attached to the inside surface of the exterior wall member; and (d) an inner door means comprising an interior wall member having an opening to allow the connector and first strap member to thread therethrough, and further comprising a second strap member with a clasp at one end of said second strap member and the other end of said second strap member attached to the inside surface of the interior wall member such that the clasp will reversibly engage to the connector and apply sufficient tension to the strap to hold the outer and inner door means against the first and second door engaging means when the clasp and connector are engaged and release the doors when the clasp and connector are disengaged.

The present invention further provides that the wall mountable safety hatch be rectangular in size to be compatible with after market or retrofit installation for conventional studded wall construction and that the door and/or frame be beveled to insure that the door readily falls out of the frame when the seat belt like clasp is released.

It is an object of the present invention to provide an inexpensive safety hatch that can be mounted through the wall of a conventional house trailer, child's bedroom or the like. It is a further object that the safety hatch be simple and reliable such that a child or youth could be taught to recognize the devide and use it in an emergency. Fulfillment of these objects and the fulfillment and the presence and fulfillment of other objects will become apparent upon complete reading of the specification and attached claims taken in conjunction with the drawings.

DESCRIPTION OF THE PREFERRED EMBODIMENTS

Figure 1:
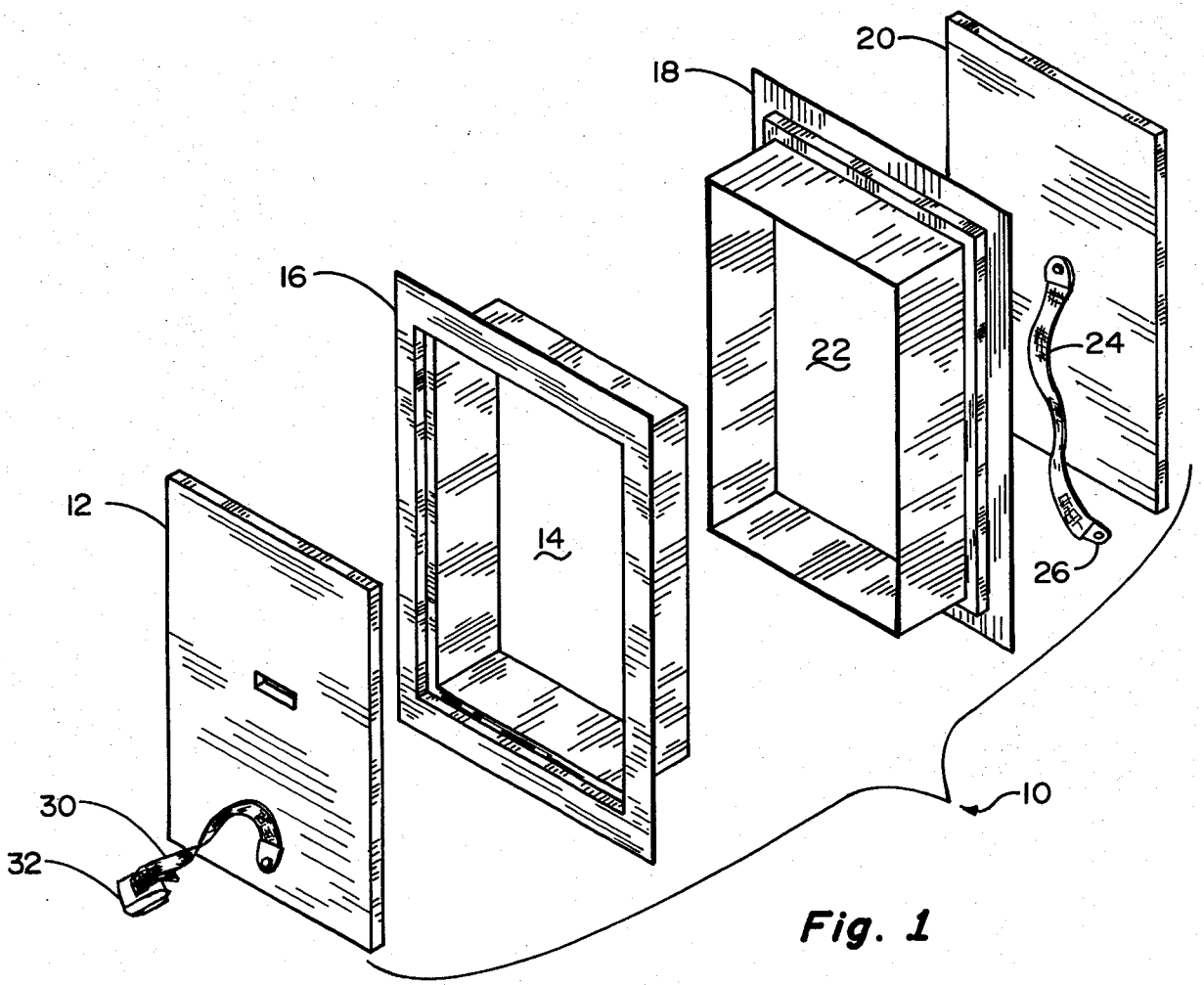
FIG. 1 is an exploded view of a wall mountable safety hatch according to the present invention.

The wall mounted safety hatch according to the present invention, how it is installed and used, how it differs from the prior art devices and the advantages over the prior art devices can perhaps be best explained and understood by reference to the accompanying drawings. FIG. 1 is an exploded view of one embodiment of the invention illustrating the individual components of the safety hatch, generally designated by the numeral 10. As illustrated, safety hatch 10 comprises an inner door or panel 12 which inserts into opening 14 or inner frame 16. Inner frame 16 telescopically engages to an outer frame 18 which is further equipped with an outer door or panel 20 that inserts into opening 22 of outer frame 18. Thus, the two doors 12 and 20 and two frames 16 and 18 assemble sequentially as implied in FIG. 1 to form the closed safety hatch 10. Preferably, the dimensions of the safety hatch 10 are selected such that it can be inserted or installed in between conventional wall studs or the like as explained and illustrated later. Centrallv anchored to the inside surface of outer panel 20 is one half of a conventional seat belt 24 which terminates in a connector 26 or the equivalent. An opening 28 is provided in a central portion of panel 12 through which seat belt connector 26 is threaded. The inside surface of inner door or panel 12 is further equipped with the other half of the seat belt 30 anchored to the door 12 and positioned such that seat belt clasp 32 can reversibly engage to seat belt connector 26 and the slack in the belt can be manually removed in the conventional manner. As such, the fastened belt will apply a compressive force thus holding the inner and outer doors 12 and 20 under tension within the frames 16 and 18. The seat belt clasp 32 is further adjusted and thus positioned on the inside of the inner door 12 such that it is highly visible and accessible to manual release in a manner readily recognizable by children.

Figure 2:
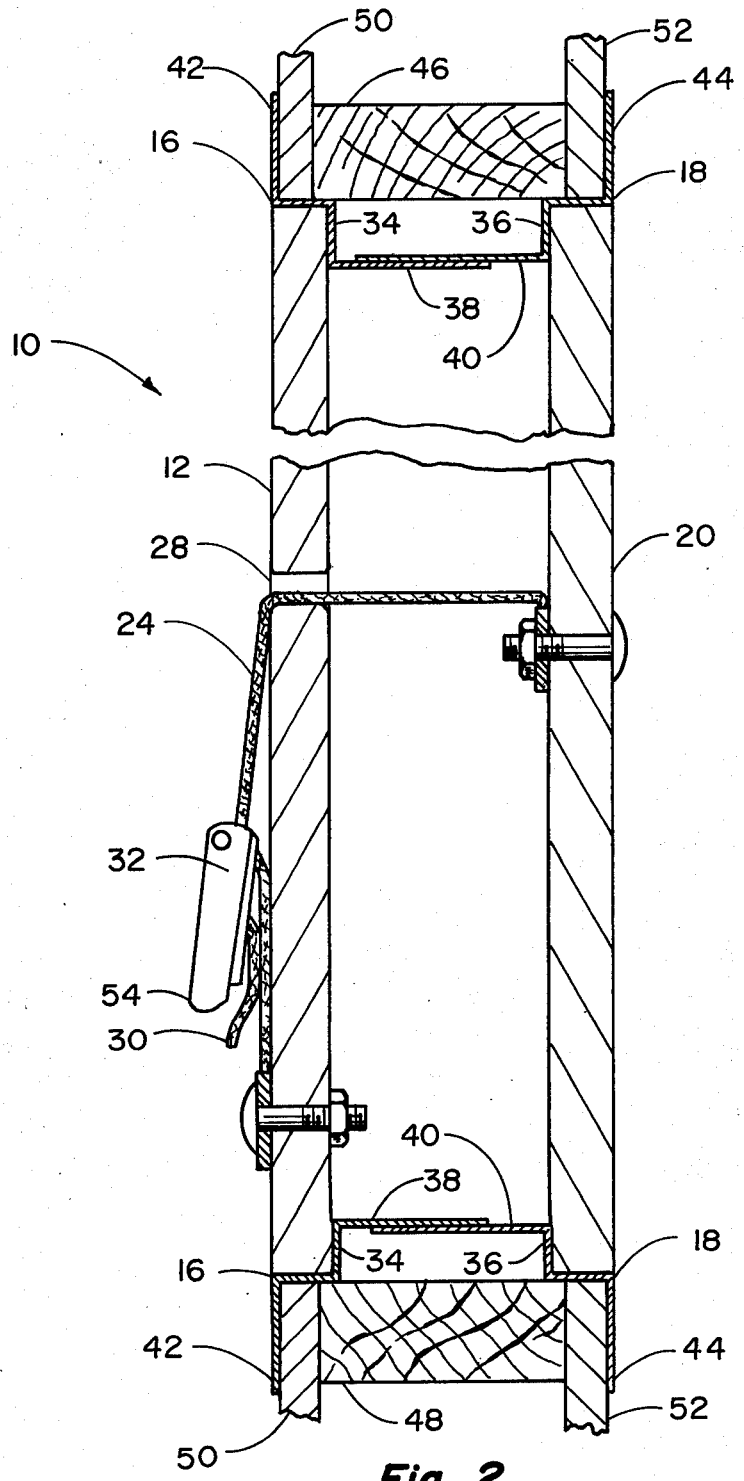
FIG. 2 is a cross-sectional view of the safety hatch of FIG. 1 mounted in a studded wall.

As illustrated in the cross-sectional view of FIG. 2, the inner frame 16 and outer frame 18 are designed to be installed directly into a wall between conventionally spaced wall studs. To accommodate this feature, the openings 14 and 22 are formed in frames 16 and 18 respectively by providing, in this embodiment, right angle internal offsets 34 and 36 that accept and retain door panels 12 and 20 in a flush mounted configuration of FIG. 2. The respective frames 16 and 18 then continue between doors 12 and 20 within the wall with concentric or telescopic surfaces 38 and 40. The exterior perimeter of the frames 16 and 18 are further equipped with surface mounted flanges 42 and 44. In this manner, the frames 16 and 18 can be readily installed during construction or as a retrofitted safety hatch. Preferably, the dimensions of the frame are selected to be compatible with standard stud spacing. For example, the width and length of the frame can be selected to fit within a 16 and 24 inch centered studding by making the frame a corresponding rectangular shape. These dimensions are also compatible with an emergency type escape hatch for most purposes.

Consequently, FIG. 2 can be viewed as a top cross-sectional view of a 24 inch spaced studded wall with the safety hatch 10 being installed with the long dimension horizontal and studs 46 and 48 being vertical wall studs between interior dry wall surfaces 50 and exterior sheeting 52. Alternatively, FIG. 2 can be viewed as a cross-sectional side view of a similar wall wherein studding 46 and 48 are horizontal inserts encasing the frame in a manner analogous to a wood framed window. It should be readily understood and appreciated that the safety hatch 10 according to the present invention can be made in various sizes other than standard studding, can be employed in other types of wall constructions, including interior walls and can be used for purposes other than an escape hatch. Further, the telescopic feature of surfaces 38 and 40 allow the safety hatch 10 to be installed in walls of varying thickness.

As further illustrated in FIG. 2, the inner and outer doors are held in an assembled configuration within the framework by virtue of the tension associated with the fastened seat belt. In order to activate or release the doors, one merely lifts up on handle 54 of seat belt clasp 32, thus disengaging the seat belt connector 26 (not shown) of the inner half 24 of the seat belt. The inner door 12 then either falls out of inner frame 16 or can be pulled out frame 16 by pulling on seat belt clasp 32. The connector 26 will readily slip through opening 28 while outer door 20 either falls outward or can be pushed out of frame 18 from the inside, thus exposing the open safety hatch for rapid exit from the room.

To replace the inner and outer door (i.e., to reassemble the safety hatch), the outer door 20 can be inserted into frame 18 from within the room by pulling on the interior half 24 of the seat belt. While retaining tension on belt half 24, the seat belt connector 26 can then be threaded through opening 28 and the inner door panel 12 can be pushed into frame 16. Connector 26 is then snapped into clasp 32 and the slack in the belt is withdrawn by pulling on the end of half belt 30.

Figure 3:
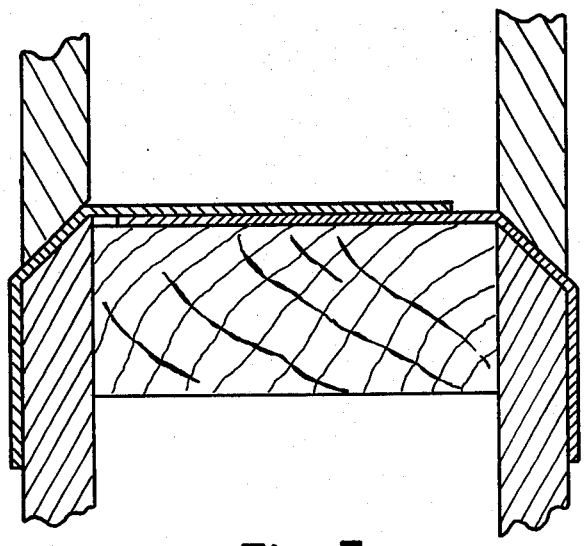
FIGS. 3 and 4 illustrate alternative methods of aligning and holding the fall-away door of the safety hatch according to the invention.
Figure 4:
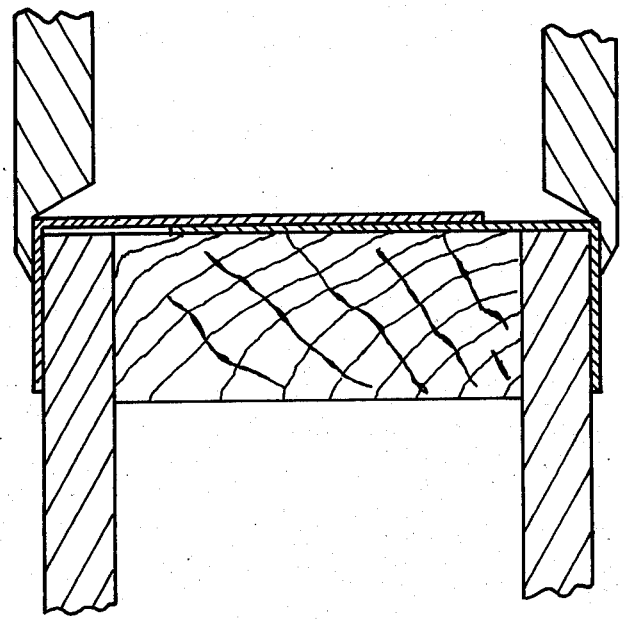

In installing the frame and safety hatch into a wall or corresponding structure, the opening through the wall in which the frame is to be mounted should preferably be elevated off the interior floor and exterior ground level such that the doors will tend to fall away from the hatch opening. To assist the exiting of the inner and outer doors when the seat belt clasp is released, the frame and/or doors can be beveled or chamfered such as to retain the desired alignment, yet insure rapid separation in an emergency situation. FIGS. 3 and 4 illustrate alternate embodiments of the feature wherein both the alignment and sloping characteristics are retained. Various other methods of insuring rapid departure of the door from the frame can be employed, including a fully equipped external door held flush to the outside of the frame and as such, should be considered equivalent for purposes of this invention. However, the flush mounted door within the frame is considered aesthetically superior and less of a security risk.

Figure 5:
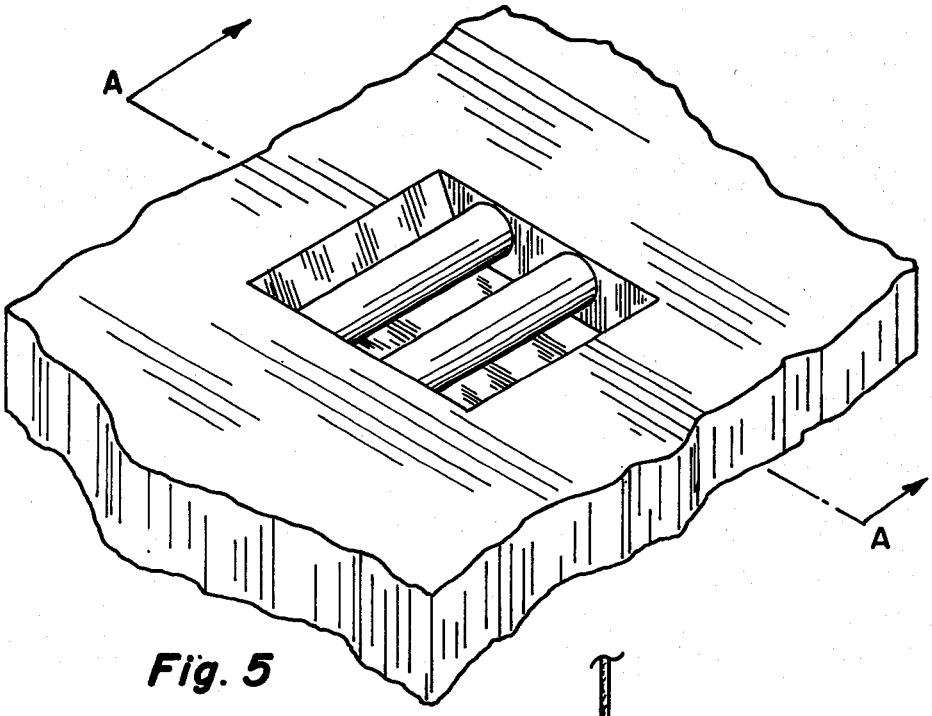
FIG. 5 illustrates an alternate method of attaching the seat belt type straps according to the present invention.
Figure 6:
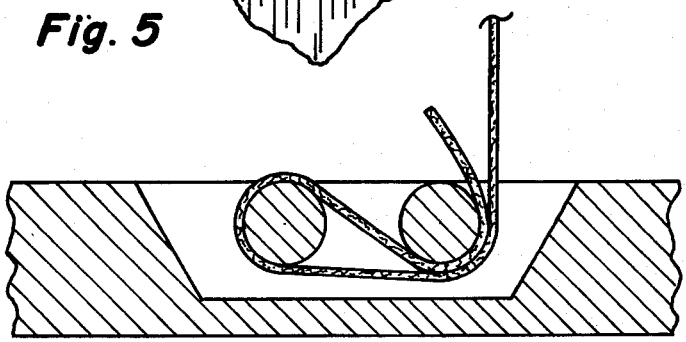
FIG. 6 is a cross-sectional view of the alternate method of attachment as seen through line A—A of FIG. 5 with belt.

Various methods of attaching the seat belt to the door can be employed as a substitute for the nut and bolt arrangement illustrated in FIGS. 1 and 2. The fastener can be riveted, screwed, tacked or nailed or the like as well as being adjustably fastened to the door as illustrated in FIGS. 5 and 6. Generally, any type of fastener or method of fastening, as well known in the art, should be considered equivalent for purposes of this invention.

The safety hatch, according to the present invention, can be manufactured out of any conventional material by methods well known in the art. The frame can be assembled from stamped sheet metal, wood molding, thermoset or thermal formed plastic sheet or injection molded thermoplastic. Preferably the frame is injection molded from a thermoplastic polymer, a fiber reinforced resin or structural foamed polymer. Similarly, the door panels can be made from metal, wood or plastic. Preferably, a low cost, injection molded thermoplastic foamed polymer similar to contemporary furniture manufacturing can be employed wherein the belt fastener, appropriate bevels or chamfered surfaces and openings can be molded into the final product without further assembly steps. The seat belt and seat belt hardware conventionally employed as safety equipment in various contemporary transportation applications can be employed in the safety hatch of the present invention. Preferably, a conventional automobile safety belt and clasp are to be used.

As previously stated, the safety hatch can be any general size and shape compatible with the specific application. It is envisioned that the safety hatch according to the present invention is particularly useful in rooms and dwellings wherein young children are present, such as children's bedrooms, schoolrooms, nurseries, day care centers, house trailers and the like.

Having thus described and exemplified the preferred embodiments with a certain degree of particularity, it is manifest that many changes can be made within the details of the invention without departing from the spirit and scope of this invention. Therefore, it is to be understood that the invention is not limited to the embodiments set forth herein for purposes of exemplification, but is to be limited only by the scope of the attached claims, including the full range of equivalents to which each element thereof is entitled.

I claim:

1. A wall mountable safety hatch comprising:

(a) a first wall mountable frame comprising a first closed-loop flange member adapted to mount against an inner wall and surround an opening in the wall through which a human can escape, a first door engaging means attached to the interior perimeter of said first flange member, and a first closed-loop sidewall member having one end attached to said first door engaging means, thus extending away from said flange member and substantially through the opening in the wall;

(b) a second wall mountable frame comprising a second closed-loop flange member adapted to mount against an exterior wall and surround an opening in the wall through which a human can escape, a second door engaging means attached to the interior perimeter of said second flange member, and a second closed-loop sidewall member having one end attached to said second door engaging means thus extending away from said flange member and substantially through the opening in the wall;

(c) an outer door means comprising an exterior wall member and first strap member with connector at one end of said first strap member and the other end of said first strap member attached to the inside surface of said exterior wall member; and (d) an inner door means comprising an interior wall member having an opening to allow said connector and first strap member to thread therethrough, and further comprising a second strap member with a clasp at one end of said second strap member and the other end of said second strap member attached to the inside surface of said interior wall member such that said clasp will reversibly engage to said connector and apply sufficient tension to said strap to hold said outer and inner door means against said first and second door engaging means when said clasp and connector are engaged and release said doors when the clasp and connector are disengaged.

2. A wall mountable safety hatch of claim 1 wherein said first and second wall mountable frames are rectangular and adapted to fit between standard wall studs.

3. A wall mountable safety hatch of claim 2 wherein said first and second door engaging means are right angle recessed grooves that accept and hold said first and second door means essentially flush to the wall.

4. A wall mountable safety hatch of claim 2 wherein said first and second door engaging means are beveled to insure said doors fall out of said frame when said clasp and connector are disengaged.

5. A wall mountable safety hatch of claim 2 wherein the perimeter of said first and second doors are beveled to insure said doors fall out of said frames when said clasp and connector are disengaged.

* * * * *